United States Patent [19]

Loffler

[11] Patent Number: 4,624,209

[45] Date of Patent: Nov. 25, 1986

[54] PORTABLE MULTI-HULL WATERCRAFT KIT

[76] Inventor: Victor R. Loffler, 32851-6th Avenue, Mission, B.C., Canada, V2V 1Z2

[21] Appl. No.: 614,060

[22] Filed: May 25, 1984

[30] Foreign Application Priority Data

Jan. 6, 1984 [CA] Canada ..... 444839

[51] Int. Cl.[4] ..... B63B 7/00

[52] U.S. Cl. ..... 114/354; 114/61; 24/115 R

[58] Field of Search ..... 114/345, 352, 353, 354, 114/355, 61, 266, 230, 251; 441/35, 40, 47; 24/115 R, 115 H, 115 K, 115 M, 136 K; 254/403; 403/286, 292; 410/101-106; 440/900

[56] References Cited

U.S. PATENT DOCUMENTS

| | | | |
|---|---|---|---|
| 2,712,293 | 7/1955 | O'Higgins | 114/61 |
| 2,745,118 | 5/1956 | Potts et al. | 114/61 |
| 3,134,113 | 5/1964 | Boyington et al. | 114/61 |
| 3,179,960 | 4/1965 | Nimmo | 114/354 |
| 3,228,042 | 1/1966 | Ogimoto | 114/354 |
| 3,364,509 | 1/1968 | Lapworth | 440/900 |
| 3,483,841 | 12/1969 | Blackburn | 114/251 |
| 3,593,684 | 7/1971 | Cogliano | 114/61 |
| 3,665,885 | 5/1972 | Javes | 114/61 |
| 3,731,644 | 5/1973 | Bradt | 114/61 |
| 3,978,536 | 9/1976 | Howe | 114/61 |
| 4,040,134 | 8/1977 | Downing | 114/354 |

FOREIGN PATENT DOCUMENTS

| | | | |
|---|---|---|---|
| 259604 | 5/1963 | Australia | 114/345 |
| 6631 | 4/1913 | United Kingdom | 114/354 |

*Primary Examiner*—Trygve M. Blix
*Assistant Examiner*—Jesûs D. Sotelo
*Attorney, Agent, or Firm*—Klarquist, Sparkman, Campbell, Leigh & Whinston

[57] ABSTRACT

A readily portable kit for assembling a multiple-hulled watercraft, such as a catamaran, from two or more open-hulled boats such as canoes. The kit in one embodiment allows the assembly, using two standard canoes, of a stable catamaran having a large deck surface. The multiple hulled vessel may be rapidly assembled or disassembled using a novel fastening system which allows the deck to be tied down with straps or other suitable hardware. In its disassembled state, the kit and hulls may be readily and compactly carried on the roof of a car or van. In its assembled condition, the deck acts to seal the open hulls, creating a stable, substantially water-tight watercraft of large capacity. The deck is constructed to enable the erection thereon of a tent, or similar collapsible shelter, including a water-tight protective shroud around the circumference of the tent, and in one variation, a protective tarpaulin above the tent.

21 Claims, 39 Drawing Figures

65
59
5
2
109

109
60
65
59
73
2

8
2
108
10
106
107
5

106

103
104
105

104
103

PORTABLE MULTI-HULL WATERCRAFT KIT

FIELD OF THE INVENTION

The present invention relates to a kit for converting standard production canoes or other open-hulled vessels into a multiple-hulled vessel, such as a catamaran, which is readily disassembled and portable, and on which when assembled, a tent or similar structure may be erected.

DESCRIPTION OF THE PRIOR ART

The advantages of multiple-hulled vessels such as catamarans in providing light yet stable watercraft with large deck areas which can be constructed relatively inexpensively are known. For example, it is known to utilize a simple catamaran structure having a large deck area on which a house trailer may be mounted to provide a stable yet inexpensive houseboat, as shown in U.S. Pat. No. 3,731,644 issued May, 8, 1973 to Bradt. A problem with such vessels is that the watercraft is not readily transportable. Various attempts have been made to render such watercraft transportable on land. For example, U.S. Pat. No. 3,978,536 issued Sept. 7, 1976 to Howe shows a double-hulled pontoon watercraft which is hinged along its longitudinal axis to allow collapsing for transporation. A trailer is generally required to transport such watercraft, although where inflatable pontoons are utilized (as in U.S. Pat. No. 2,745,118 issued to Potts) or where the craft is small enough (as in U.S. Pat. No. 3,179,960 issued to Nimmo) the folded and disassembled craft may be carried on a cartop rack.

It is also known to utilize canoes of standard construction in the assembly of a catamaran-type boat to reduce the expense of manufacturing such boats. For example, U.S. Pat. No. 4,040,134 issued Aug. 9, 1977 to Downing shows the use of two standard canoes in a stable pontoon boat. Catamarans of such designs, however, require substantial modifications to the canoes, are not readily disassembled, and can only be easily transported by providing them with their own trailer arrangement. Other attempts have been made to convert two canoes into a light, easily disassembled and portable catamaran, such as that shown in U.S. Pat. No. 2,712,293 issued July 5, 1955 to O'Higgins. Such designs have not successfully provided the stability, deck-area and load-carrying capabilities of the less portable pontoon boats.

SUMMARY OF THE INVENTION

The present invention provides a kit for converting two canoes or other boats of open hull construction, having gunwales into a stable multi-hulled watercraft, such as a catamaran, which both has substantial load-carrying capabilities and is quickly and easily assembled and disassembled to be carried on the roof of a car or van. The kit comprises essentially a deck, means for aligning the deck on the gunwales of standard production canoes or other boats, means to provide a seal between the deck and the gunwales of the boats, and means for removably securing the deck to the canoes or other boats.

In one aspect of the invention, the deck is formed of a number of sections which can be stacked for easy portability on a car-top rack or the like. According to a further aspect of the invention, the kit may include a removable transom, which may also function as part of a car-top rack. Adjoining deck sections may be hinged or may be sealed by a waterproof joint. According to a further aspect of the invention, the deck may be provided with hatches in order to allow access to the interior of the hulls.

According to a further aspect of the invention, the means for removably securing the deck to the boat or canoe comprises a fastener which is secured to the interior of the sides of the boat or canoe. The guide in one fastener has a substantially semi-circular passageway which is adapted to receive a rope or strap. The deck is provided with holes or notches which may be aligned with such passageway, so that once the deck is aligned over the boats or canoes, a rope may be fed through the hole or notch, through the strap guide and out through a second hole or notch in the deck surface to allow the deck to be tied down.

According to a further aspect of the invention, the deck is adapted for erection thereon of a tent or similar collapsible shelter. In another aspect of the invention, a tarpaulin or canopy may be erected over the deck surface to provide additional shelter. Fastening means may be provided on the deck surface to secure the tent. An impermeable skirt or shroud, preferably of flexible transparent material, may be secured around or incorporated into the lower circumference of the tent structure to provide further waterproofing.

BRIEF DESCRIPTION OF THE DRAWINGS

In the accompanying drawings which illustrate an embodiment of the invention.

DETAILED DESCRIPTION OF AN EMBODIMENT OF THE INVENTION

Figure 1:
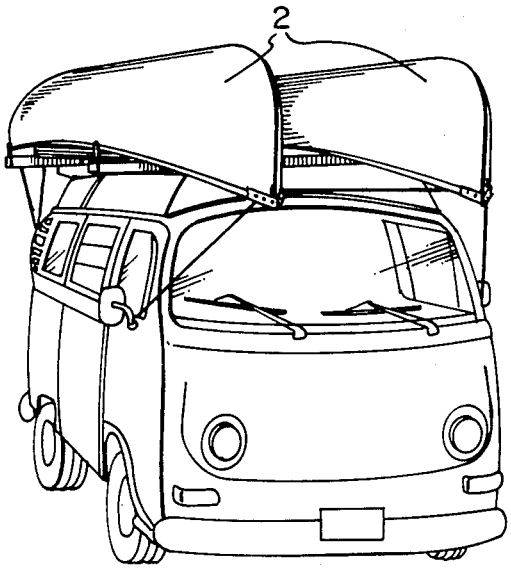
FIG. 1 is a perspective view of the kit of the present invention in disassembled form and accompanying canoes arranged for transportation on a car-top carrier.
Figure 2:
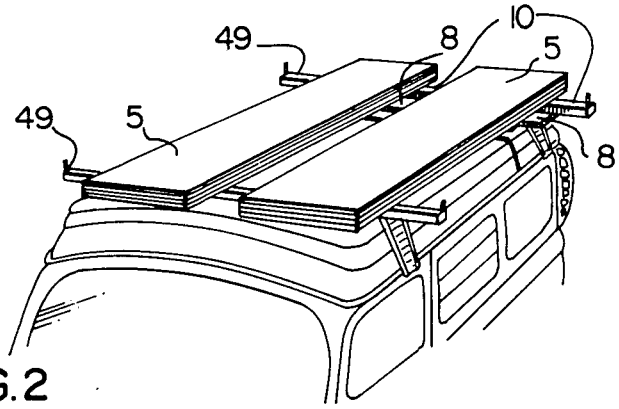
FIG. 2 illustrates in perspective the kit in disassembled form as in FIG. 1 with canoes removed.

The kit in collapsed and packaged form is illustrated in FIGS. 1 and 2. As seen in FIG. 1, the kit may be disassembled and compactly stacked for transportation on a roof top carrier. The two canoes have been removed in FIG. 2 to illustrate the arrangement. Two stacks of four deck sections each are formed on the roof top rack. A canoe fits over each stack to be tied down to the car or van. One of the supporting bars of the roof top rack 49 is formed from the transom beam 10. Transom plate 8 is placed downward on the car or van roof. Additional hardware may be attached to transom plate 8 to facilitate roof rack use.

Figure 3:
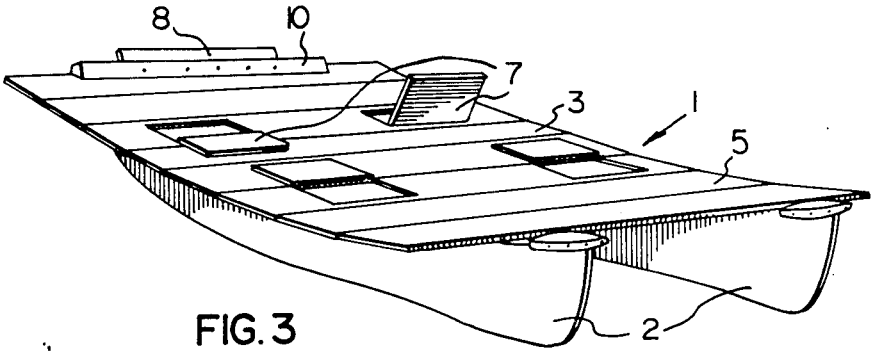
FIG. 3 is a perspective view of a catamaran constructed using the kit of the present invention prior to the erection of any deck structures.

Referring to FIG. 3, which illustrates the assembled deck and hull structure, a catamaran constructed according to the kit of the present invention using two standard canoes is shown generally as 1. In this embodiment, 18 foot V-stern or flat back canoes are shown designated as 2 although other sizes or types of canoes or other open-hulled boats, such as standard aluminum fishing runabouts, sailing hulls, or dinghys (see for example the open hull fishing runabout in FIG. 31) may be used as effectively. The open-hulled boats in question need only have gunwales which are sufficiently strong to support the deck structure. The canoes or boats are of standard construction and need not be specially modified apart from the provision of fastening means. The fact that pre-existing boats or canoes can be used as pontoons in this craft, and can be reused as standard watercraft once the craft has been disassembled, substantially reduces the expense of the catamaran of the present invention.

The deck, designated as 3, may be of any suitable material but is conveniently constructed of ¾ inch plywood. Where 18 foot canoes are utilized for the pontoons, the preferred deck size is 10 feet by 16 feet. The deck is divided into a number of sections of manageable size, preferably 2 foot widths designated as 5 in FIG. 2. For ease of assembly, adjoining pairs of deck sections may be hinged using conventional means at 6 in FIG. 4*a.* The paired hinged sections may then be joined by rigid tie plates 90 (See FIGS. 24 and 25.) Certain deck sections may be provided with hatches having hinged hatch covers 7 in order to provide access to the interior of the canoes for storage. At the rear of the deck may be attached a transom plate 8, attached to transom beam 10, for supporting an outboard motor. Detachable bracing may be incorporated for use with the entire transom combination when added strength is required. Each deck section may be provided with holes or slots 9 for receiving straps or ropes to tie down the deck sections to the canoes by means of the fastening means to be described below.

Figure 4B:
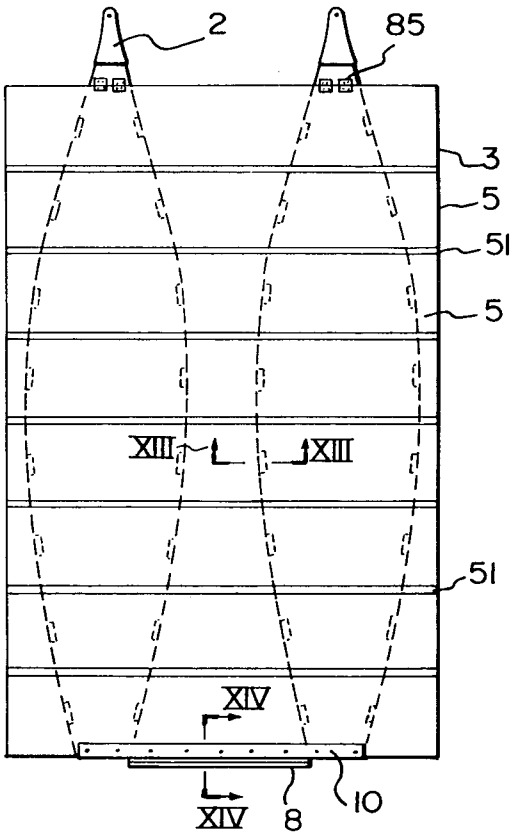
FIG. 4*b* is a top plan view of an alternative construction of catamaran.

FIG. 4*b* illustrates an alternative deck assembly which utilizes H-seals 51 between the sections 5. These can be seen in greater detail in FIGS. 9 and 10 and will be discussed in more detail later in this disclosure. FIG. 4*c* illustrates a cross section left side view of the arrangement of the deck sections 5 on the canoe 2. Bolts 21 in the side of the canoe 2, and keeper pins 39, to be discussed later, are shown. The transom plate 8 and the transom beam 10 are also shown.

Figure 6:
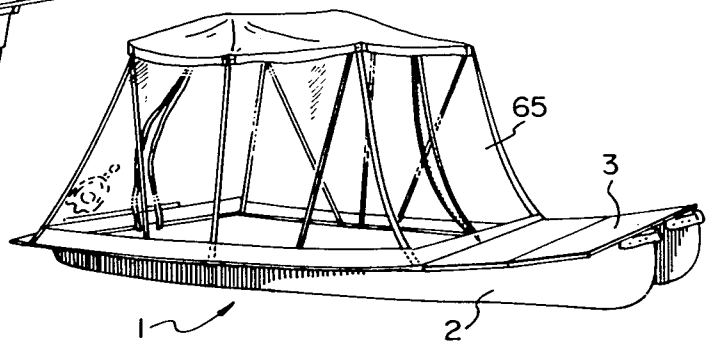
FIG. 6 is a perspective view of the catamaran of FIG. 3 with a screened tent structure erected on the deck and with attached outboard motor.
Figure 8:
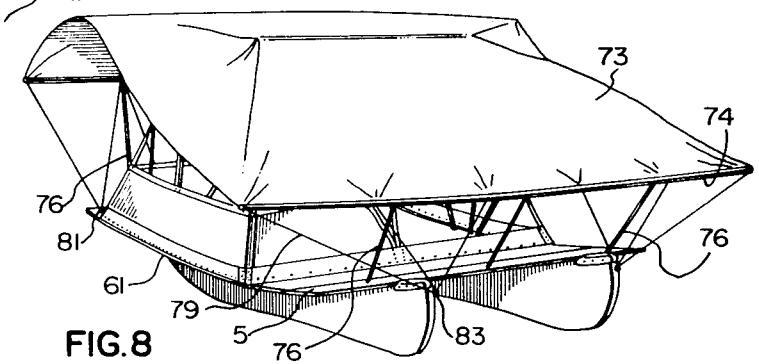
FIG. 8 is a perspective view of the catamaran shown in FIG. 7 with the addition of a tarpaulin or canopy.
Figure 7:
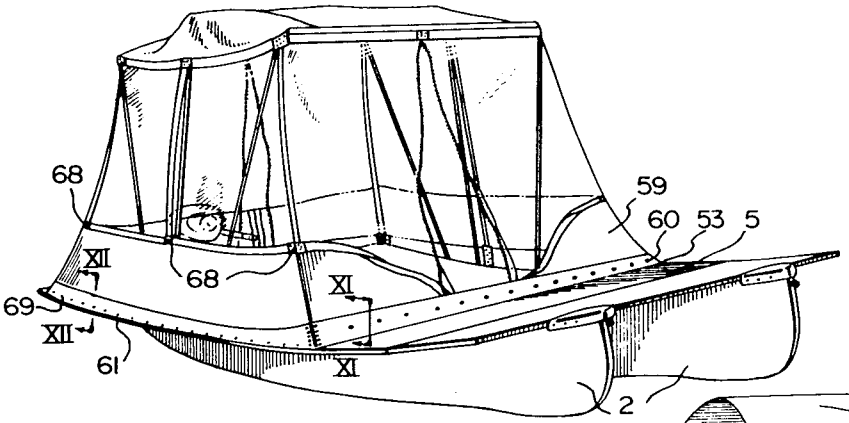
FIG. 7 is a perspective view of the catamaran of FIG. 6 with the addition of a shroud to the lower circumference of the tent structure.

The catamaran so constructed provides a watercraft of exceptional stability and load-carrying ability. The large deck area allows the catamaran to be converted to a house or patio boat by erecting a tent and/or canopy on the deck as shown in FIGS. 6, 7 and 8. The catamaran is also well suited for rough water. Because the fastening means of straps or rope have some flexibility, the connections are not completely rigid. The resulting "give" allows a certain amount of independent motion as between the two pontoons and protects the craft from damage due to excessive stress. A seal provided between the gunwales of the canoes and the deck, causes the craft to be substantially water-tight. Once the deck is assembled, the joints between sections and the holes provided for the tie-down straps or ropes can be sealed using duct tape. The resulting deck is substantially free of projections which adds to the safety of the craft and facilitates the erection of structures on the deck.

Figure 10:
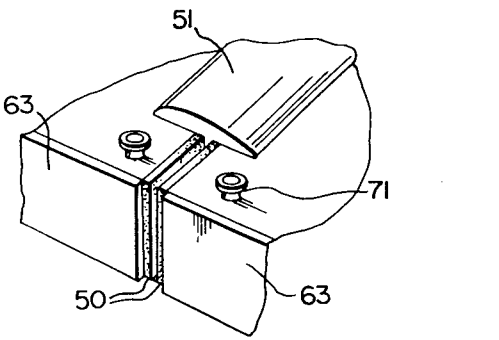
FIG. 10 is a perspective view of a joint between deck panels in the catamaran of the present invention provided with snaps for tent and/or shroud attachment.
Figure 9:
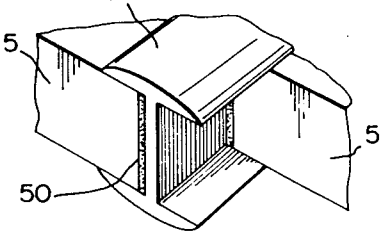
FIG. 9 is a perspective view of a joint between adjoining deck panels with one panel partially removed.
Figure 15A:
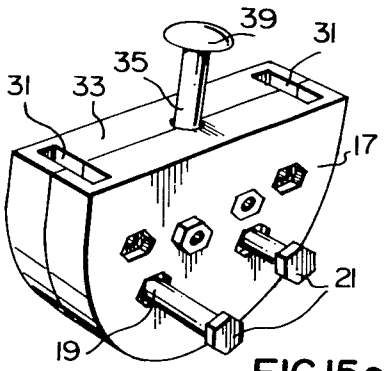
FIG. 15*a* is a perspective view of one fastening device of the invention.
Figure 15B:
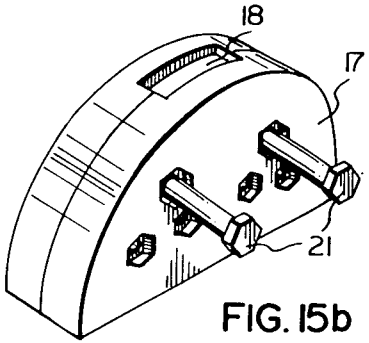
FIG. 15*b* is an inverted view of FIG. 15*a;*

FIGS. 9 and 10 show in detail an H-shaped seal 51, made of rubber or similar flexible, durable, waterproof material which is placed between deck sections 5. (See also FIG. 4*b*.) This provides a seal between adjoining deck sections. Compressible seal 50 may be used in association with seal 51, to prevent the sliding of panels and also to cushion the shroud which will be described further below.

Figure 13:
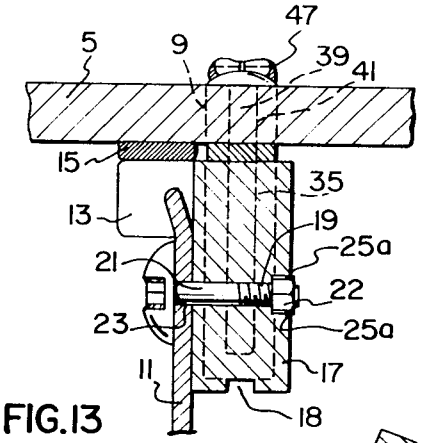
FIG. 13 is a cross-sectional view taken along section line XIII—XIII of FIGS. 4*a*, 4*b*.

FIG. 13 shows a cross-sectional view of the deck, fastening means and supporting gunwale of the canoe.

The side of the canoe or boat, which will typically be fibreglass or aluminum, is designated as 11. Supported on the side 11 is gunwale 13 which typically is constructed of metal or similar suitable material for strength and durability. Secured to the upper surface of the gunwale is a strip of sealing material 15 which will generally be made of resilient, waterproof rubber or foam material. The sealing material 15 can be secured to the gunwale along its entire length. Alternatively, the sealing material 15 may be secured to the underside of the deck in the appropriate position. (This is the preferred method in the embodiment shown.)

The deck may be tied down and concurrently aligned to the canoes 2 simply by providing predrilled holes 41 in the deck section 5 and in the seats and thwarts or yoke of the underlying canoes. Ropes or straps may then be passed through the holes and tied down tightly. However a novel means of fastening the deck to the canoes is also provided which allows the deck section 5 to be tied down and released quickly from above the installed deck. The guide portion of the novel fastening device is shown as 17 in FIGS. 13, 15, 16 and 17. The fastener 17 is provided with two horizontal holes 19 to receive bolts 21. The side of the canoe or boat is similarly provided with horizontal holes 23 for receiving bolts 21. The fastener 17 is also provided with two recesses 25 which incorporate holding tabs 25*a* for receiving and retaining suitable nuts 22 for bolts 21. Individual rubber washers may be used between the head of bolt 21 and the side of the canoe, or a single elongated waterproof piece may be used to distribute the pressure against the side of the canoe as bolts 21 are tightened.

Figures 16A, 16B, 17, 18A, 18B, 18C, 18D, 18E:
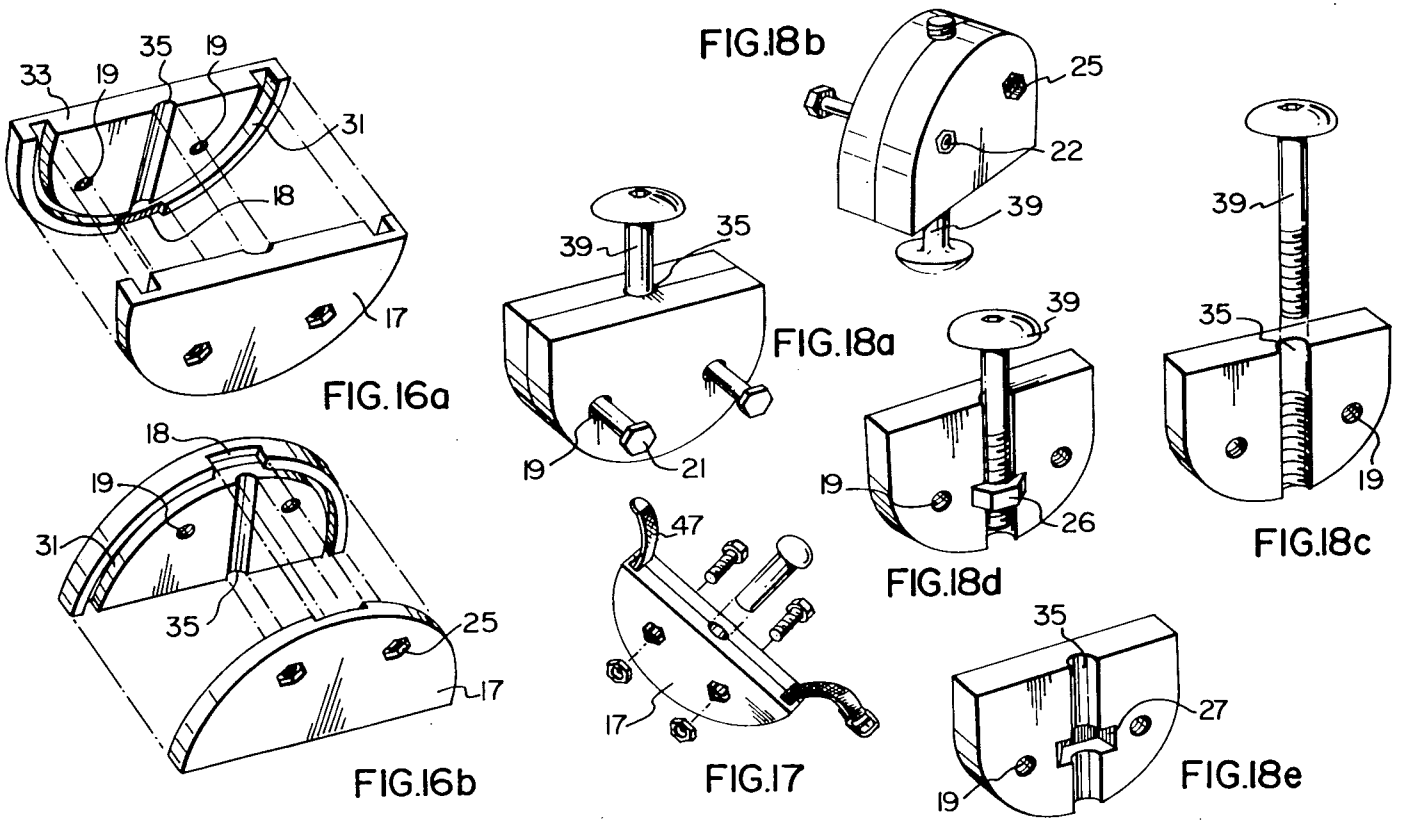
FIG. 16*a* is an exploded view in perspective of the fastening device shown in FIG. 15*a;*
FIG. 16*b* is an inverted view of FIG. 16*a;*
FIG. 17 is a perspective view of the fastening device shown in FIG. 15*a* with strap inserted.
FIG. 18*a* is a perspective view of a second embodiment of the fastening device.
FIG. 18*b* is an inverted view of FIG. 18*a;*
FIG. 18*c* represents a partial section perspective view of a threaded fastening device.
FIG. 18*d* represents a partial section perspective view of a fastening device with a bolt and nut combination in place in the interior thereof.
FIG. 18*e* represents a partial section perspective view of the fastening device of FIG. 18*d* with the bolt and nut removed.

Fastener 17 is shown as semi-circular in shape in the drawings, but other exterior shapes for the device are suitable. As seen in FIG. 16*a*, (FIG. 16*b* is inverted) the device is provided with a continuous slot 31 which proceeds around the outer portion of the fastener from a point adjacent one end of the upper surface 33 to the other end. The fastener 17 is conveniently manufactured in two halves which may be snapped together by providing each half with appropriate means where the fastener is moulded from plastic, or the two halves may be held together by bolt 21. The fastener guide has a cut-out 18 which allows dirt or debris to be removed from slot 31. The fastener 17 is also provided with a central hole 35 which is adapted to receive a bolt or keeper pin 39 which serves to align the deck sections over the fastener guide. The deck sections are provided with a hole 41 to receive bolt 39. Fastening guide 17 is secured to the inside of the canoe just below the level of the gunwale using bolts 21 and nuts 22. Each deck section is aligned over the fastening guide 17 using keeper pin 39. The deck section may then be tied down using strap 47. The free end of the strap 47 shown in FIG. 17 is inserted through one of the slots 9 cut in the deck section 5. The free end of the strap 47 is then pushed through channel 31 in the guide member to emerge through the opposite matching slot 9 in the deck section 5. The strap 47 may then be tightened and secured. The strap 47, when tightened also secures the keeper pin 39 in place. To release the deck section, the process is reversed. Thus the deck may be tied down from above the deck with a strap 47 or rope without the requirement that any operations be carried out below the deck.

Figure 20:
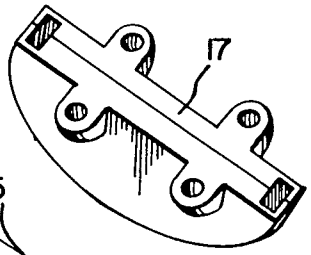
FIGS. 20 and 21 are alternative embodiments of the fastening device shown in FIG. 15*a.*
Figure 21:
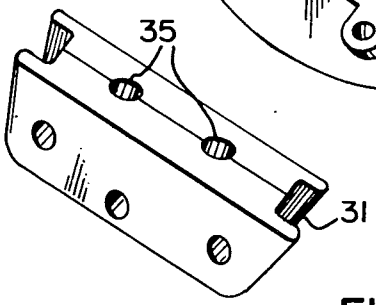

While the fastener described above is the preferred means for securing the deck to the canoes in the catamaran kit of this invention, it is apparent that other types of fasteners may be suitable. The canoes may simply be provided with holes in appropriate locations, with matching holes being provided in the deck sections. Ropes or straps may then be passed through the holes and tied down. Similarly, a block of wood, plastic or similar material may be substituted for fastener 17 and may be adapted to receive a bolt and retain a nut in order that a bolt may be passed through a hole in the deck and tightened into a nut retained in such block or the block internally threaded. Such embodiments are shown in FIGS. 18*a*, 18*b*, 18*c*, 18*d* and 18*e*. The block itself would be fastened to the side of the canoe much as fastener guide 17. A bolt with a head incorporating sufficient base surface area, may be employed to secure the deck to the fastener below. An advantage of fastener guide 17 with strap 47 over this latter embodiment is that no tools would be needed to tie the deck down. Furthermore, use of straps or ropes provides a certain amount of "give" to the craft which is helpful in resisting damage due to excessive stress. FIGS. 20 and 21 illustrate alternate embodiments of guide 17, having more than one guide hole 35, or a slot 31 which is open to the exterior of the body of the guide and therefore will not be self-guiding.

Figure 14:
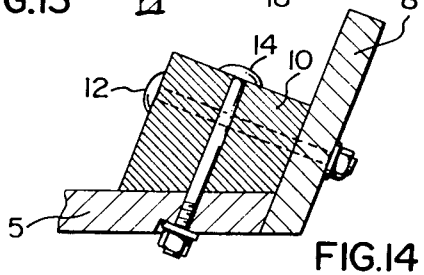
FIG. 14 is a cross-sectional view taken along live XIV—XIV of FIGS. 4*a*, 4*b*.

To assemble the catamaran, the two canoes or other boats are placed roughly parallel and apart on the ground, or if need be on the water, as shown in FIG. 3. The integrity of the seal on the upper surface of the gunwales or the underside of the panels is checked. Individual sections, (which may be numbered to assist assembly) or hinged pairs of sections are then positioned on the canoe gunwales, and keeper pins 39 are inserted through respective holes in the deck panel. Prior to securing the rear section, the transom beam 10 is bolted into position at the rear of the sternmost panel section. As illustrated in FIG. 14, the transom beam 10 is optimally chamferred to provide an angle greater than 90° between the deck and the transom plate 8. Each section 5 is then tied down using straps or ropes and the fastening devices 17 as described above. Joints between adjoining sections 5 may be sealed using the H-shaped rubber seal 51 shown in FIG. 9. Also prior to tying down the sections, a shroud may be secured along the underside of the forward edge of one of the frontmost panels, such as at 53 in FIG. 11 to be used later as a spray or splash guard for the forward part of the craft. Once the sections 5 have been tied down, the fastening straps and also joints between sections may be further waterproofed with duct tape, or the like. To disassemble the catamaran, the steps described are simply reversed.

Figure 11:
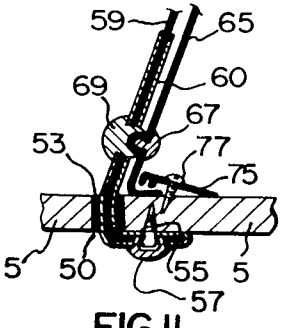
FIG. 11 is a cross-sectional view taken along section line XI—XI of FIG. 7.

FIG. 11 illustrates a manner in which a waterproof skirt or shroud 59 may be attached to the deck section 5 to be subsequently secured to a tent erected on the deck. Snap male portion 55 may be installed on the underside of deck section 5 to receive female snap portion 57 which is installed in the border of the shroud 59. The shroud 59 has a lower reinforced section 60 to receive the snaps. In FIG. 11, the attachment of the shroud 59 to the deck section 5 between adjoining sections is illustrated. Depending on the size of the tent, this will normally be installed at location 53 shown in FIG. 7. The shroud 59 also is provided with female snap elements 69 to receive a male snap element installed in the tent 65. The upper portion of the shroud at 68 (see FIG. 7) is also provided with snaps to secure it to the tent ultimately installed. Alternatively, the tent may be constructed to incorporate the shroud 59 on its lower portion, in which case the bottom of the tent would circumvent the edge of deck section 5 and be attached in a manner similar to the shroud previously described.

Figure 12:
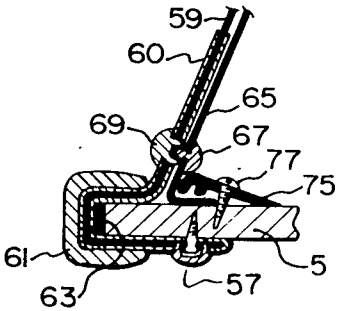
FIG. 12 is a cross-sectional view taken along section line XII—XII of FIG. 7.

As shown in FIG. 7, the shroud 59 may also extend along the port and starboard deck edges of the craft. To protect the shroud material 59 along the deck edges, a construction as shown in FIG. 12 may be utilized. A strip of suitable sealing material 63 may be installed along the edge of the deck, and a durable guard or bumper 61 may be installed over the shroud 59 along the edge of the deck.

Once the deck sections 5 are in place, the collapsible tent structure 65 may be erected as shown in FIGS. 6 and 7. The edges of the tent may be secured to the deck using clamps 75 and screws 77 as shown in FIGS. 11 and 12. Alternatively, the deck on its top side or underside may be equipped with male snap elements 71 (See FIG. 10) to receive female snap elements installed in the lower edge of the tent structure as is already employed to secure the shroud 59 to the underside of the deck section 5. Snaps 71 should be offset to ensure they do not collide when the panels are folded or stacked.

While any self-supporting collapsible tent of appropriate size is suitable, a structure which has considerable visibility and also allows access to the outboard motor at the rear has been found most suitable. Smaller self-support pup tents may be installed within the interior of the larger tent as sleeping accommodations. For additional protection in wet weather, a tarpaulin or canopy 73 may be installed over the tent structure as shown in FIG. 8. The ends of the tarpaulin 73 are tied to poles 74. The poles 74 are pivotally fastened to support elements 76 which are in turn fastened to the deck of the craft. The ends of the tarpaulin is supported by the tent structure, and is secured to the bow and stern of the craft by stays 79. The stays are preferably tied to the canoe bows at 83 and to the rear deck of the craft at 81. This allows a certain amount of flexibility in the positioning of the canopy 73. Alternatively, flexible panels can be incorporated on the sides of the collapsible tent 65 to facilitate weatherproofing when required, and provide privacy within the tent 65.

The resulting catamaran provides a watercraft of exceptional stability and load carrying capacity. The tent or canopy may be erected on the large deck area to provide a houseboat. Use of the aforementioned shrouds 59 may be used to provide additional protection from spray in rough water to a tent or living area. Luggage, gasoline or toilet facilities may be stored in the open canoes by accessing same through the hatches 7. As previously mentioned, while nuts and bolts may be utilized to secure the deck to the canoes, this will require use of tools, and results in a more rigid craft. The use of straps or ropes is preferred as no tools are required for assembly and disassembly, and the resulting craft is less rigid and more flexible in rough water as a result. It will also be seen that the hulls of the canoes have been essentially sealed by the use of sealing material between the deck and the gunwales. The resulting craft is therefore substantially water-tight, and if the fit of the deck to the canoes is such that the entire open area of the canoes is not covered, additional measures may be taken as with an additional sealed hinged hatch 85 (see FIGS. 4*a*, 4*b*, and 4*c*) to completely enclose the canoe hulls 2.

Figure 4A:
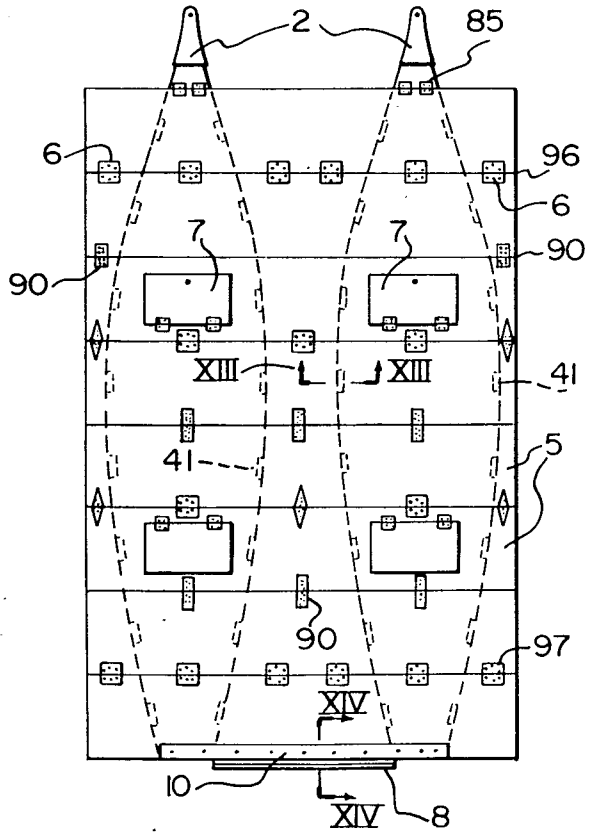
FIG. 4*a* is a top plan view of the catamaran of FIG. 3.
Figure 4C:
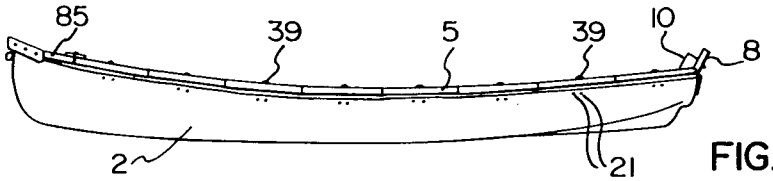
FIG. 4*c* is a side elevation view of the catamaran of FIG. 3.
Figure 5:
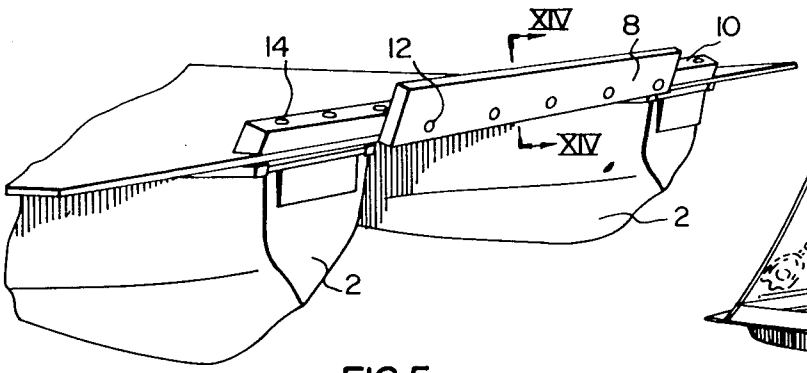
FIG. 5 is a perspective view of the transom construction of the catamaran shown in FIG. 3.
Figure 22:
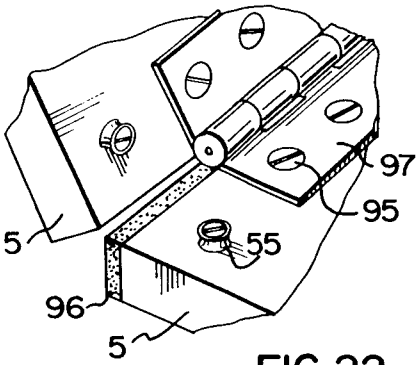
FIG. 22 is a perspective close-up view of a deck section with hinge and seal.
Figure 23:
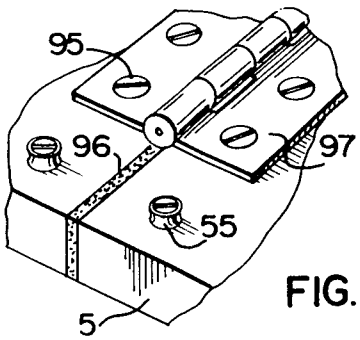
FIG. 23 is a perspective close-up of the deck section of FIG. 22 in laid-out position.
Figure 19:
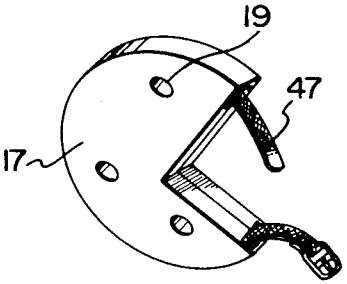
FIG. 19 shows an alternate embodiment of the fastening device for 90° attachments.

FIGS. 22 and 23, which illustrate the underside of the deck, demonstrate in detail the manner in which adjacent deck sections 5 (as illustrated in FIG. 4*a* in plan view) are fitted together in pairs. A waterproof sealing material 96, similar to weatherstripping, is located between the sections 5. The sections are joined by hinges 97. Snaps 55 are used to fasten down the edges of the shroud 59.

Figure 24:
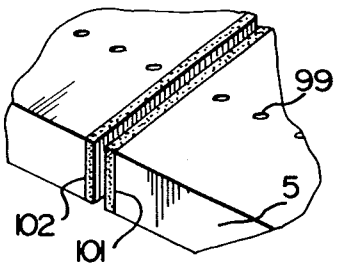
FIG. 24 is a close-up perspective view of a deck section with seals between each section.
Figure 25:
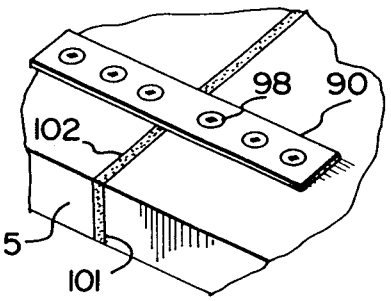
FIG. 25 is a close-up perspective view of the section of FIG. 24 with a tie plate installed.

FIGS. 24 and 25 illustrate the method of securing pairs of sections 5 together by the plates 90. As seen in FIG. 4*a*, these plates 90 alternate with hinges 97. The tie plates are fastened to the sections 5 by screws 98 and predrilled holes 99 in the sections. A waterproof seal 101, or a pair of seals 101 and 102, sit between the sections 5 and provide a waterproof barrier.

Figures 26, 27, 28, 29, 30, 31:
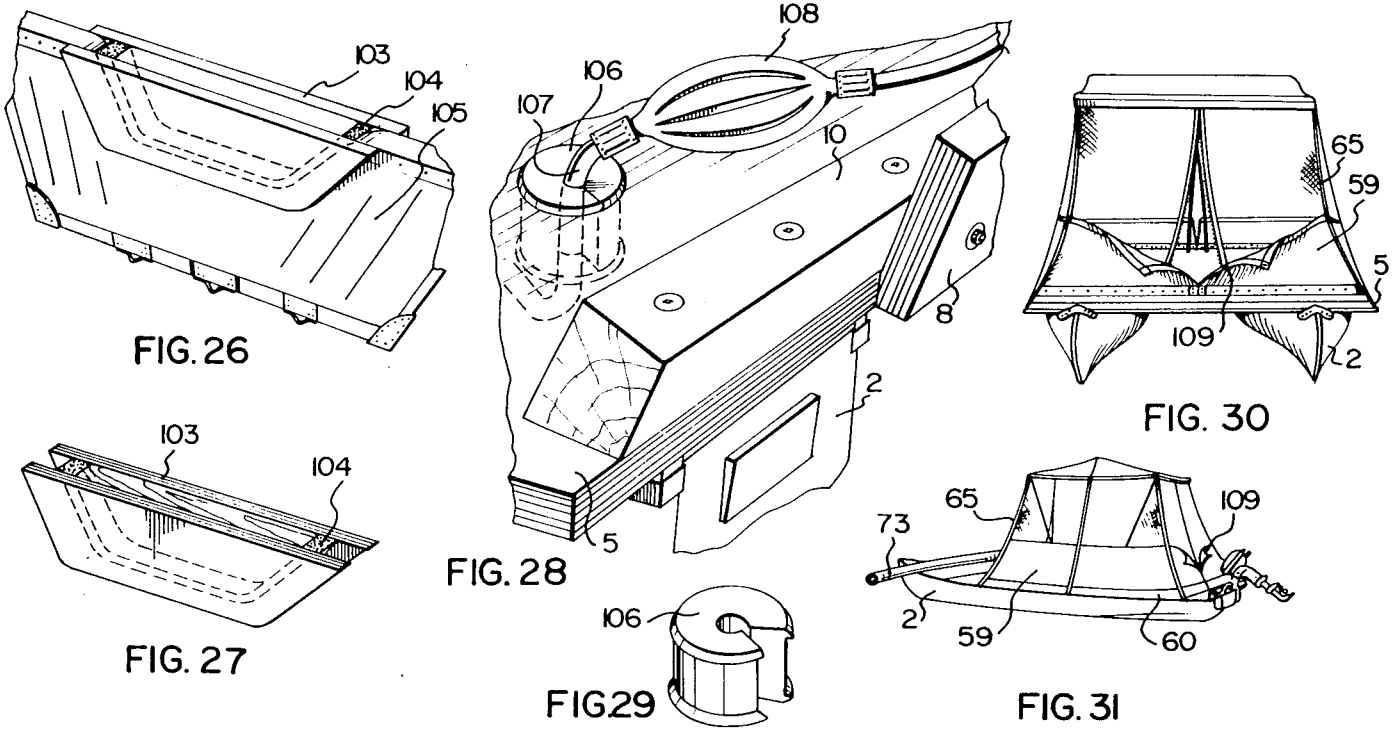
FIG. 26 is a perspective view of a transom gap filler installed on a boat hull transom.
FIG. 27 is a perspective view of the transom filler of FIG. 26.
FIG. 28 is a perspective close-up view of the fuel line fitting coming through a deck section.
FIG. 29 is a perspective view of the fuel line hole stopper.
FIG. 30 is a perspective view of the front of the catamaran showing the access way through the shroud.
FIG. 31 is a side perspective view of the catamaran with tent and rolled tarpaulin.

FIGS. 26 and 27 illustrate in perspective the construction of a transom gap filler 103 which can be used to fit within the transom gap of a standard open aluminum fishing boat 105. A thick flexible resilient seal 104 attached to the underside of 103 enables the filler 103 to seal the transom opening when installed as in FIG. 26. Filler 103 may be constructed according to various shapes. The filler 103 permits the interior of the boat 105 to be closed to the exterior when the sections 5 are installed as a deck on the boat 105. In addition, if the deck bearing configuration of the gunwale is such that a large gap would occur when the deck is installed, a gunwale gap filler designed to fill the gap can be utilized.

FIGS. 28 and 29 illustrate a stopper 106, formed of a soft rubbery material, which can be used with the gas line 107 of a standard outboard motor fuel tank system equipped with a pumping bulb 108. The stopper 106 provides a water seal and also prevents chaffing of the fuel line 107 against the section 5. This allows the end of the fuel line to be pulled through the deck. Wiring may also be handled in this manner.

FIG. 30 illustrates the accessway 109 which is formed in shroud 59 in order to provide a walkway into the tent 65. The tarpaulin 73 is rolled compactly at the front of the watercraft, see FIG. 31.

The kit, including canoe, tent and canopy weighs only about 400 pounds and can be readily transported by car-top carrier.

It will be seen that an inexpensive kit has been provided for converting existing open-hulled boats having gunwales, such as canoes, into a multi-hulled vessel. It will be apparent that more than two such hulls may be utilized to provide a multiple-hulled craft of even greater stability, load-carrying capability and deck area. Also, a larger or smaller number of deck sections may be used, depending on the means provided for transporting the kit. In the embodiment described, a combination transom 8 and 10 is provided for use of an propulsion may be used, such as a sail by providing a socket or other means for supporting a mast. It will also be apparent that, while canoes 2 are particularly well suited for kits of the present invention, other open-hulled boats such as fishing runabouts and sailing hulls are also suitable. Because one is able to utilize previously purchased canoes or boats, the cost of constructing the catamaran is significantly reduced. While it is necessary to attach the novel fastening means described above directly to the canoes or boats, the canoes or boats can be utilized apart from the catamaran with the fastening means intact, or such fastening means can be easily removed and any holes sealed to return the boats to their original condition. Because the fastening devices may be left permanently on the canoes, or incorporated in their manufacture, the subsequent assembly procedure for converting the canoes into the catamaran craft are substantially simplified. It will also be seen that the repeated assembly and disassembly of the craft is extremely easy and rapid once the fastening devices have been initially installed. The deck sections can be tied down while standing on the deck due to the novel fastening guide. Also, once the craft is assembled, there are few hazard promoting projections on the deck unlike existing catamaran kits. Because the deck sections may be constructed from standard sizes of plywood, the expense of the kit is further reduced.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A kit for converting at least two watercraft hulls having gunwales into a multi-hulled watercraft having a deck surface comprising:

(a) a deck comprising a plurality of sections which can be stacked into a compact portable unit, the deck being adapted to bear on said gunwales;

(b) means for aligning the deck on the gunwales so that the hulls are parallel and in alignment with one another, said alignment means being located on the deck so as to correspond with the inboard side of the gunwales;

(c) a plurality of removable deck securement receiving means adapted to be secured at a plurality of locations along the inboard sides of the gunwales;

(d) a plurality of deck securement means which can be operated solely from above the deck for removably securing the deck to the deck securement receiving means; and (e) reusable sealing means located between the plurality of sections for sealing the deck joints between sections against water transmission between the sections.

2. The kit of claim 1 further comprising second reusable sealing means for sealing the joint between said deck and said gunwales.

3. The kit of claim 1 wherein the deck is adapted to receive a bolt, and the deck securement receiving means comprises a body having a passageway which incorporates a receiving means adapted to receive and secure the bolt.

4. The kit of claim 1 wherein the deck is adapted to receive a threaded bolt, and the deck securement receiving means comprises a body having a threaded passageway therein adapted to receive and secure the threaded bolt.

5. The kit of claim 1 wherein said deck includes at least one hatch located to permit access to the interior of one of said watercraft when the deck is secured to the gunwales of the warercraft.

6. The kit of claim 5 further comprising means for supporting an outboard motor, said supporting means also adapted to act as a roof rack when transporting said kit in disassembled form.

7. The kit of claim 6 wherein said deck is adapted to accommodate a removable collapsible shelter.

8. The kit of claim 7 further including means for removably securing a flexible waterproof barrier to said deck and to the lower circumference of said shelter, said barrier incorporating a closable waterproof passageway for entry into the shelter.

9. The kit of claim 6 further comprising means for removably suspending and securing a protective covering above said deck.

10. The kit of claim 6 wherein the outboard motor supporting means is a removable transom which can be installed at the mid-region of the rear of the aft deck section.

11. The kit of claim 1 wherein deck section stabilizing means are incorporated between each deck section.

12. The kit of claim 1 wherein the watercradt hulls have transoms and the kit includes transom gap filling and sealing means.

13. The kit of claim 1 including a gunwale gap filling and sealing means.

14. The kit of claim 1 including means adapted to enable electrical wiring and a fuel line to be removably accessible from the interior of at least one of said hulls to the upper side of the deck.

15. The kit of claim 1 wherein the sealing the sealing means between the plurality of sections is constructed of a waterproof resilient material which has sufficient rigidity and cooperates with the adjoining sections to cause the adjoining sections to maintain alignment when a weight is applied downwardly on one or more of the sections.

16. The kit of claim 15, wherein the sealing means has an H-shaped cross-section, the edges of adjacent sections fitting into the respective recesses of the H-shaped seal means.

17. The kit of claim 1 wherein the deck is adapted to receive a flexible restraining means and wherein the deck securement receiving means comprises a body having an upper surface and a passageway adapted to receive the flexible restraining means, the passageway opening adjacent the one end of the upper surface and passing throuch the body in a substantially continuous path and emerging adjacent the opposite end of the upper surface, the body being adapted to receive means for securing the body to the hull of the watercraft.

18. The kit of claim 1 wherein the alignment means is an elongated means which passes through an opening in the deck into a receiving passageway in the deck securement receiving means.

19. The kit of claim 1 wherein the plurality of deck sections extend across the gunwales of the watercraft hulls in a lateral direction.

20. The kit of claim 1 wherein said deck is adapted to receive a rope or strap and wherein said securing means comprises a body having an upper surface and a passageway adapted to receive a strap or rope, said passageway opening adjacent one end of said upper surface, passing through said body in a substantially continuous path and emerging adjacent the opposite end of said upper surface, said body being adapted to receive means for securing said body to the hull of said watercraft.

21. A kit for converting at least two watercraft hulls having gunwales into a multi-hulled watercraft comprising:

(a) a deck adapted to bear on said gunwales;

(b) means for aligning said deck on said gunwales; and (c) means for removably securing said deck to said gunwales, wherein said deck is adapted to receive a strapping means and wherein said securing means comprises a body, having an upper surface and a passageway adapted to receive a strapping means, said passageway opening adjacent one end of said upper surface, passing through said body in a substantially continuous path and emerging adjacent the opposite end of said upper surface, said body being adapted to receive means for securing said body to the hull of said watercraft.

* * * * *